United States Patent [19]

James

[11] Patent Number: 5,067,755

[45] Date of Patent: Nov. 26, 1991

[54] LOCKING MECHANISM FOR A SAFE DOOR

[76] Inventor: C. Thomas James, 460 N. 880 East, Springville, Utah 84663

[21] Appl. No.: 638,068

[22] Filed: Jan. 7, 1991

Related U.S. Application Data

[63] Continuation of Ser. No. 374,257, Jun. 30, 1989, abandoned.

[51] Int. Cl.[5] ..... E05C 9/12

[52] U.S. Cl. ..... 292/33; 109/59 R

[58] Field of Search ..... 109/59 R; 292/33, 51, 292/39, 142, 172

[56] References Cited

U.S. PATENT DOCUMENTS

| | | | |
|---|---|---|---|
| 393,883 | 12/1888 | Brown, Jr. | 70/144 |
| 473,800 | 4/1892 | Van Broek | 292/39 |
| 533,298 | 1/1895 | Hollar | 292/39 |
| 1,251,467 | 1/1918 | Blixt et al. | 292/142 |
| 1,600,982 | 9/1926 | Galloway et al. | 292/39 |
| 1,870,746 | 8/1932 | Pyle | 292/335 |
| 1,929,341 | 10/1933 | Wegner | 242/5 |
| 1,996,865 | 4/1935 | Hoag | 292/39 |
| 2,823,536 | 2/1958 | Watson | 70/1.5 |
| 2,860,584 | 11/1958 | Deaton et al. | 109/59 |
| 3,308,579 | 3/1967 | Thams | 49/192 |
| 4,679,415 | 7/1987 | Spratt | 292/39 X |

*Primary Examiner*—Richard E. Moore

*Attorney, Agent, or Firm*—Trask, Britt & Rossa

[57] ABSTRACT

A locking mechanism for use in a lightweight safe includes a toothed spur main drive gear mounted on a rotatable axis journaled through the safe's door. The main drive gear mechanically engages a pinion gear which in turn meshes with a vertically disposed rack gear. A second pinion gear also engages the rack gear and further engages a second drive gear. A securement locking mechanism, mounted to the interior face of the safe door proximate the main drive gear, is adapted for cooperation with the main drive gear for detachably restraining the main drive gear in a non-rotative orientation. The pinion drive gear/rack gear arrangement is adapted to transfer motion from the main drive gear around the aforesaid securement mechanism to the second drive gear. Each drive gear is mechanically associated with one or more laterally displaceable rack gears adapted to be displaced into engagement with the safe door frame to produce a locking engagement therewith.

10 Claims, 4 Drawing Sheets

LOCKING MECHANISM FOR A SAFE DOOR

This is a continuation of application Ser. No. 07/374/257, filed June 30, 1989, now abandoned.

BACKGROUND OF THE INVENTION

1. Field

This invention relates to locking systems, particularly those used for gun safes and other types of lightweight safes.

2. Statement of the Art

In the past decade, public awareness of the hazards arising from private gun ownership has increased markedly. As politicians grapple with the issue of ensuring the safety of the public while protecting the constitutionally endowed rights of private gun ownership, individual gun owners have become more aware of the need to safeguard their personal gun collections. One of the more popular approaches adopted by these individuals is the purchase of a lightweight safe designed for storing rifles as well as handguns. These safes at once provide security against criminal activities, e.g. burglary, while at the same time providing a means of precluding access to the weapons by children.

These safes typically assume a substantially box-like appearance having a hinge-mounted, rectangularly shaped door which provides access to the safe's hollow interior. For years, safe manufacturers have relied on a locking mechanism which provides for a series of studs or bolts to be urged outwardly from the four-sided perimeter of the door, into recess wells defined in the door's frame. Various mechanical arrangements have been proposed to effect the actuation of these bolt members.

U.S. Pat. No. 393,883 (Brown) illustrates a safe door adapted with a plurality of stud-fitted yokes positioned about the perimeter of the door. Each yoke includes a shaft which extends towards the center of the door face and is retained for back-and-forth displacement within a series of bracket-like guides. The shafts are interconnected one with another by a pivot mounted linkage assembly. The locking mechanism is actuated by a spring.

U.S. Pat. No. 1,870,746 (Pyle) discloses a safe door wherein a rotatably mounted disc is fitted with a first plurality of pinned outwardly-extending shaft linkages. Two of the linkages are pinned at their opposing ends to a respective second rotatably mounted disc. A second plurality of linkages extend from pinned mountings in the second discs to the perimeter of the door. Each of the linkages in the second plurality of linkages is fitted at its free end with a stud adapted for insertion into a frame defined recess well. Additionally, one of the first linkages is also adapted at its free end with a stud adapted for insertion into a frame defined recess well.

U.S. Pat. No. 1,929,341 (Wegner) describes a locking mechanism adapted for use in closing a burial vault. In this construction, a disc, centrally positioned and rotatably mounted on the vault door, is fitted with a plurality of outwardly extending shafts. Each shaft is fitted on its free end with a yoke fitted with a plurality of outwardly extending studs or legs adapted for cooperating with structure defined on the main body of the vault for effecting a unison of the door with the vault body.

U.S. Pat. No. 2,823,536 (Watson) discloses a safe door mechanism which utilizes two spacedly positioned discs rotatably mounted on as safe door. Each disc is fitted with two pinned shafts which extend outwardly to the door's perimeter and are adapted at their ends to be received within frame defined recess wells to form a secured union of the door with the safe door frame.

U.S. Pat. No. 2,860,584 (Deaton et al.) discloses a bolt and lock construction adapted for use with vault doors.

SUMMARY OF THE INVENTION

A locking assembly for use with the door of a lightweight safe is disclosed. The assembly includes a manually actuated, rotatable main drive gear mounted on the interior face of the safe door which communicates through the door to a manually operated actuation means, e.g. a hand graspable handle, mounted on the door's exterior surface.

The main drive gear is mechanically associated with a plurality of follower or pinion gears and a motion relaying first rack gear interposed between the pinion gears. A first pinion gear in meshed engagement with the main drive gear is positioned proximate a securement means adapted for mechanically cooperating with that first pinion drive gear to interdict the rotation thereof, and thereby further precluding the rotation of the main drive gear. The pinion gears and first rack gear are arranged to transfer motion from the main drive gear, about the perimeter of the securement means, to a secondary drive gear spacedly mounted from the main drive gear, e.g. elevationally above the main drive gear. This secondary drive gear is mechanically associated with one or more laterally displaceable second rack gears, whose displacement is effected by a rotation of the secondary drive gear.

In one embodiment, the second rack gear(s) may be mechanically associated with one or more auxiliary gears rotatably mounted on the safe door's interior face. The auxiliary gear(s) may in turn be mechanically associated with a respective third rack gear adapted for displacement in a direction orthogonal, i.e. perpendicular, to the displacement direction of the second rack gears. Both the second rack gears and the third rack gear(s) are fitted at one or more of their ends with a stud adapted to be received within a respective recess well defined in a frame of the safe door. Upon a given displacement of the respective second and third rack gears, the studs are individually urged into their corresponding recess wells, thereby securing the door to the frame, which frame in turn is securely mounted to the body of the safe.

In presenting this disclosure, the safe door will be described as being oriented upright and vertical. It should be understood that the invention is equally employable on doors positioned in other orientations, e.g. horizontal or angulated.

The invention further includes embodiments wherein a plurality of fourth drive gears are spacedly and rotatably mounted along a height or length of the safe door.

Each pair of the fourth drive gears are mechanically associated by a linkage means interposed therebetween, such as an intermediate idler gear.

One of the third drive gears is mechanically associated with the main drive gear whereby a rotation of the main drive gear effects a corresponding rotation of each of the third drive gears through intermediation of the intermediate idler gears. Mechanically associated with each third drive gears is one or more second rack gears, of the type described above, adapted to be displaced through their interaction with a rotating third drive gear. These second rack gears are fitted with a stud at one or more of their ends which, as described previously, is configured to be received in a respective recess well of the safe door frame.

In some constructions, an opposingly mounted second rack gear may be associated with each second rack gear, whereby a rotation of each third drive gear causes one rack gear of the pair to be displaced in a first direction and another rack gear of the pair to be directed in a second direction 180° removed from the direction of the first rack gear.

Through use of the intermediate idler gears, the various second rack gears may be arranged in vertically oriented arrays wherein the various second rack gears constituting each array may be urged in unison toward a common side edge of the safe door and the door frame positioned proximate that safe door side edge. Further, opposing arrays of second rack gears may be urged simultaneously in opposite directions toward the respective frame recess wells.

In an alternative embodiment, both the elevationally uppermost and elevationally lowermost primary rack gears, i.e. the outermost positioned second rack gears, may be mechanically associated with an auxiliary spur gear and an associated auxiliary rack gear oriented for displacement in a direction orthogonal to the direction of travel of the second rack gears. In one construction, those auxiliary rack gears may be positioned proximate opposing sides, e.g. the top and bottom, of the safe door. Each of these auxiliary rack gears may be fitted with a corresponding stud on one or more of the ends, adapted to be received within a respective recess well defined in the safe door frame.

Operationally, the invention provides a locking structure wherein the manual rotation of a single main drive gear causes a transfer of motion around the securement means associated with the main drive gear to a secondary drive gear and a plurality of second rack gears associated therewith, adapted for simultaneous displacement laterally toward opposing sides of the safe door. Further, the safe locking structure is adapted for simultaneously displacing auxiliary rack gears orthogonally toward the top of the safe door.

The main drive gear is further mechanically adapted for transferring motion to a plurality of third drive gears mounted along the height of the safe door. Each third gear is associated with one or more primary rack gears oriented for lateral displacement towards opposing sides of the safe door upon a rotation of their respective third drive gears. Further, at least one of the third drive gears may be associated with one or more auxiliary rack gears oriented for vertical displacement toward the bottom edge of the safe door.

In total, the invention provides a means of simultaneously and measuredly displacing a plurality of stud- or bolt-fitted rack gears from an interior region of the interior face of the safe door outwardly toward the upright side edges, top edge and bottom edge of the door where those bolts are urged into a lock-producing association with recess wells defined within the safe door frame which circumscribes the door.

DETAILED DESCRIPTION OF THE INVENTION

A preferred embodiment of the invention is disclosed in FIGS. 1–8.

The Safe

Figure 1:
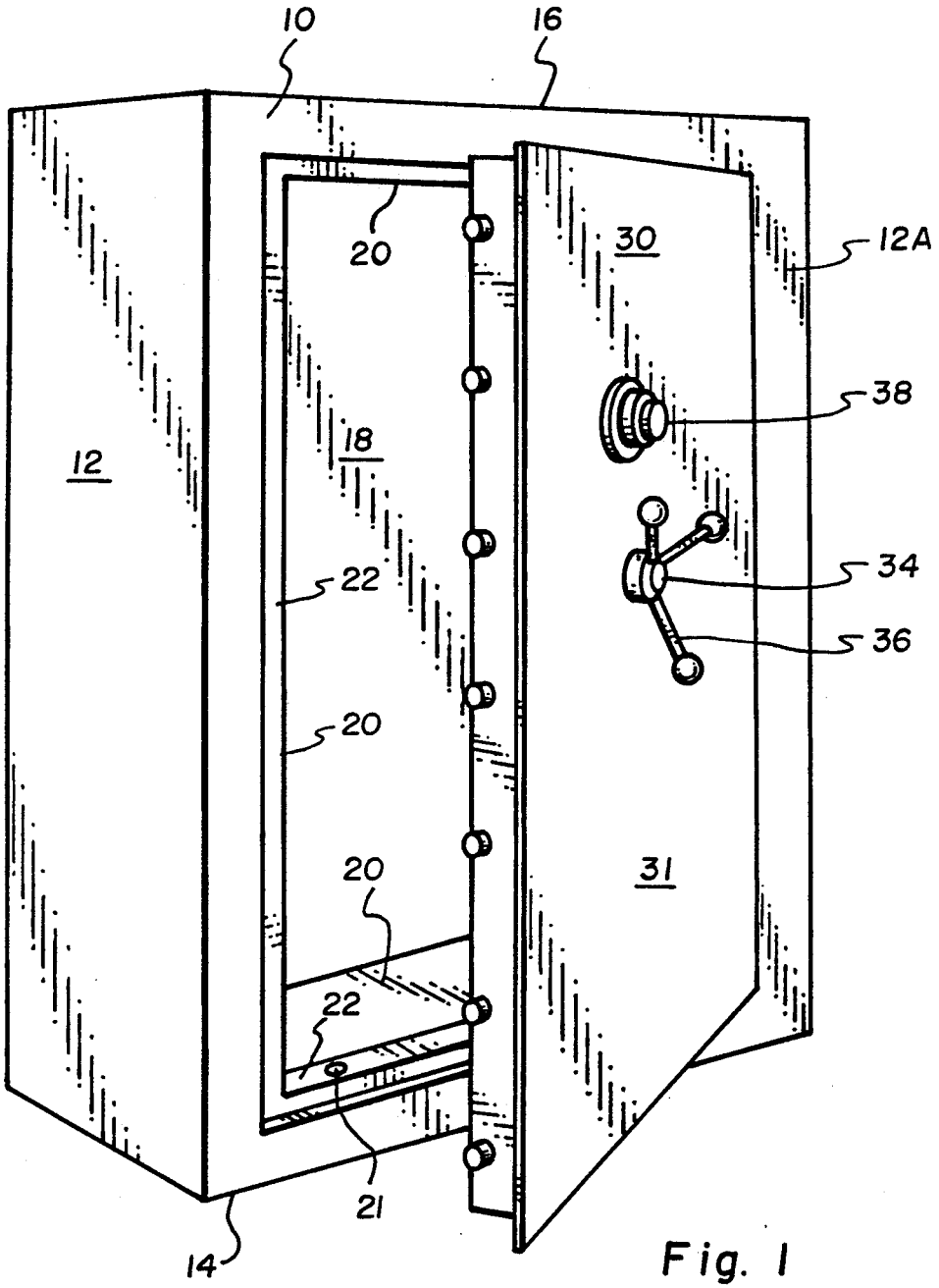
FIG. 1 is a front elevational view of a lightweight safe showing the handle and key lock of the locking mechanism.

As shown in FIG. 1, a lightweight safe generally 10 includes a plurality of upright planar panels 12 mounted to each other on their upright edges to form a box-like configuration. A bottom panel 14 is mounted to the lower perimeter of the box-like configuration. A top bottom 16 is mounted to the top of the box-like configuration whereby the safe 10 is totally enclosed.

FIG. 1 illustrates the front upright panel 12A as defining a generally rectangular opening 18 therein. The opening 18 is enclosed by a frame 20 composed of a plurality of "L"-shaped panels 22 which extend from the panel 12A inward to the hollow interior of the safe. The panels 22 are joined together at their ends to form a generally rectangular structure. The frame 20 defines a plurality of apertures 21 therein at spaced intervals along the length of each of the four panels which compose it. Each of the apertures passes completely through its respective frame panel 22.

The Door

Figure 2:
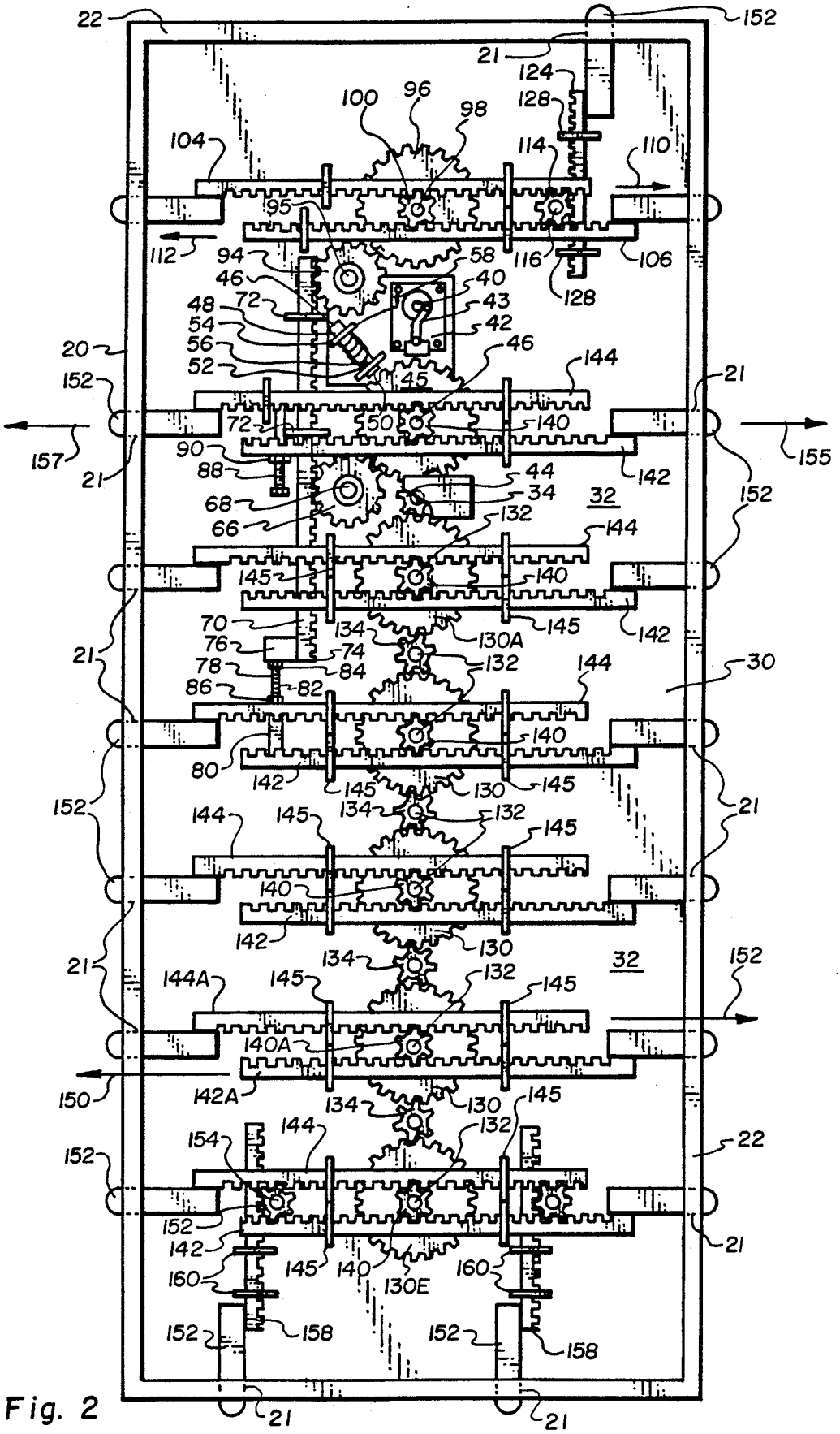
FIG. 2 is a front elevational view of a safe door within a frame enclosure.

The door 30 of the invention is a rectangularly configured planar panel having an exterior face 31 and an interior face 32, as shown in FIG. 2. An elongate, cylindrical axle drive shaft 34 is journaled through the door 30 and may be supported by bearings. A spoked wheel-like handle 36 is mounted on the outwardly extending end of axle shaft 34. Handle 36 is configured to be grasped and rotated by the safe's user as a means of operating the locking mechanism.

The Key Lock

A combination lock mechanism 38 is mounted on the exterior face 31 of the door 30. This mechanism, which may be of a conventional rotary dial-type, communicates with the interior face of the door through an aperture defined within the door 30. The combination lock mechanism is adapted to actuate a securement mechanism 40 mounted on the interior face of the door 30.

Alternatively, the combination lock mechanism 38 may be a conventional key lock-type mechanism.

The Interior Securement Mechanism

As shown in FIG. 2, the locking mechanism 40 includes a lateral extending bolt 42, mounted on a support shaft 43. The bolt 42 is adapted to be displaced vertically, either upwardly or downwardly by the rotation in the combination lock mechanism 38. Upon a given downward displacement, it engages with the teeth of a first transfer spur gear 45 which is rotatably mounted on the end of a horizontally oriented axle shaft 35. The teeth of main drive gear 44 are meshed with the teeth of first transfer spur gear 45, which is mounted rotatably on a horizontal axis 47 mounted on door 30. The bolt 42 is sized to be received between a pair of adjacent teeth of transfer gear 45. Since the bolt 42 is not adapted to be rotated, but merely displaced vertically, upon its positioning between the described pair of adjacent teeth, it interdicts and locks the first transfer spur gear 45 in place and prevents any rotation of main drive gear 44.

A secondary securement means 46 is illustrated in FIG. 2. This securement means 46 is adapted to secure the safe 10 in the event that the main key locking means 40 is disabled. As shown, this secondary locking means 46 includes a cylindrical shaft 48 having an end 50 dimensioned to be received between a pair of adjacently positioned teeth of first drive spur gear 44.

The shaft 48 includes a laterally extending pin 52 mounted thereon. The shaft 48 is slidably mounted within two guides 54 which are mounted to the interior face of the safe door. Shaft 48 extends through a coil spring 56 which abuts on its first end against the uppermost guide 54A. The second end of the spring 56 abuts against the pin 52. A connecting bar 58 extends from the lock mechanism 40 to the shaft 48. The bar 58 retains the shaft 48 in a raised position by means of a laterally extending pin 60 mounted thereon which is received within a detent recess well defined in shaft 48. Should the securement mechanism 40 be forcibly detached from the interior face of the safe door, e.g., by a blow directed to the combination lock mechanism 38 on the door's exterior face, the connecting bar 58 would be detached, thereby retracting the pin 60 from the detent opening in the shaft 48 whereupon spring 56, acting on pin 52 would urge the shaft 48 into engagement with first spur transfer gear 45, i.e., between a pair of adjacent teeth of that first spur gear 45. Since the guide 54 permits the shaft 48 to be displaced solely in the directions indicated by arrow 62, the shaft 48 locks the first spur transfer gear 45 in place and precludes its further rotation.

First transfer spur gear 45 is of a conventional spur gear construction and is adapted to be rotated both clockwise and counterclockwise. Mounted proximate first transfer spur gear 45 is a toothed pinion or follower gear 66. This pinion gear 66 is journaled on an elongate, cylindrical axle 68 mounted on the interior face of the safe door to extend outwardly (laterally) therefrom.

The teeth of pinion gear 66 are meshed with an elongate rack gear 70 which is retained in an upright orientation by two guides or supports 72 mounted on the interior face of the safe door. Each guide may be essentially a planar panel member having an aperture defined therein configured to receive the rack gear 70. The guides 72 are adapted to retain the teeth of rack gear 70 in mechanical engagement with the teeth of pinon gear 66, while also permitting that rack gear 70 to be slidingly displaced vertically, i.e. downwardly or upwardly, upon a clockwise or counterclockwise rotation of pinion gear 66. The first end 74 of rack gear 70 is fitted with a laterally protruding extension 76. A stop 78 is mounted to the interior face of the safe door by means of a support block 80. As illustrated, stop 78 may be constructed from a male threaded bolt 82 having a head 84 which is positioned to abut against the extension 76, thereby precluding any further downward displacement of rack 70. The bolt 82 is threaded into a nut 86 which is mounted on support block 80. The elevation of the bolt head 84 may be adjusted by threading the bolt 82 either further into the nut 86 or retracting it outwardly therefrom.

A second stop 88 is mounted elevationally above the first stop 78. This second stop 88 is structurally identical to stop 78 with the exception that the retaining nut 90 is mounted above as opposed to below the main body of its respective bolt. Stop 88 abuts against extension 76 upon a given upward displacement of rack gear 70, thereby precluding the further upward displacement of that rack gear 70 beyond a specific height.

Proximate its second end 92, rack gear 70 is mechanically engaged, i.e., its teeth are meshed, with the teeth of a second pinion gear 94 which is rotatably mounted on a cylindrical axis 95 mounted on the interior face of the safe door to extend outwardly therefrom. The teeth of pinion gear 94 are meshed with the teeth of a second drive spur gear 96 which is mounted on an axle 98. Second drive gear 96 is adapted for rotation about a horizontal axis defined by the axle 98 which is mounted on interior door face 32 to extend horizontally outwardly therefrom.

The association of the pinion gear 66, rack gear 70, and pinion gear 94 are adapted for transferring motion from the manually rotated first drive gear 44 to the second drive gear 96. More specifically, the association of gears 45, 66, 70 and 94 are adapted to transfer motion around the securement mechanism 40 mounted on the interior face 32 of the safe door 30. Recognizing that this securement mechanism 40 should be positioned contiguous the first transfer spur gear 45 for optimal operation, the aforesaid association of gears permits that optimal securement mechanism 40 orientation while simultaneously providing means of actuating that portion of the locking bolt mechanism positioned directly above the main drive gear 44 without interfering with the securement mechanism 40 positioned between the main drive gear 44 and the described portion of the locking bolt mechanism.

Mounted coaxially with second drive gear 97 on axle 98 is a toothed auxiliary drive spur gear 100. Auxiliary gear 100 is mounted on drive gear 96 by means of a sleeve-like extension 102 which extends therebetween. The teeth of auxiliary drive gear 100 are meshed with the teeth of opposingly positioned, elongate rack gears 104 and 106 which are slidingly mounted in respective guide support 108. The rack gears 104 and 106 are adapted for lateral displacement in opposing directions, e.g., upon clockwise rotation of auxiliary gear 100, rack gear 104 is directed to the right as indicated by arrow 110 while rack gear 106 is directed to the left as indicated by arrow 112. Interposed between the rack gears 104 and 106 is a pair of toothed auxiliary pinion gears 114. As shown in FIG. 2, the auxiliary gears 114 are positioned spacedly apart from one another whereby an auxiliary pinion gear 114 is positioned proximate each pair of opposing ends of rack gears 104 and 106. Each gear 114 is journaled on an axle 116 which is mounted on the interior face 32 of safe door 30. The teeth of each gear 114 are meshed with the teeth of the two rack gears 104 and 106, whereby a displacement of the rack gears 104 and 106 effects a corresponding rotation of the gears 114.

Figure 3:
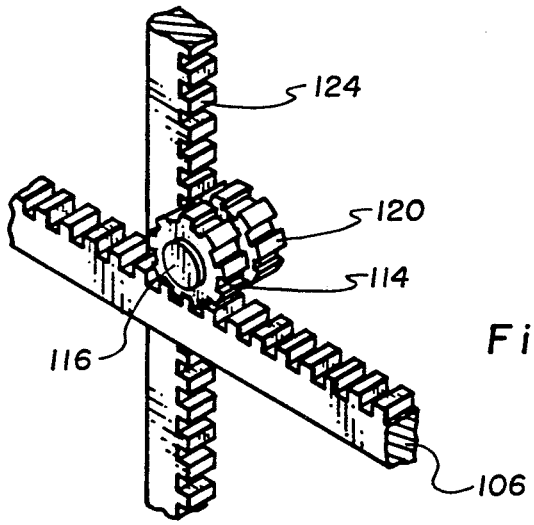
FIG. 3 is an elevated sectional perspective view of a pair of orthogonally oriented rack gears mounted in mechanical engagement with an auxiliary driving gear.
Figure 8:
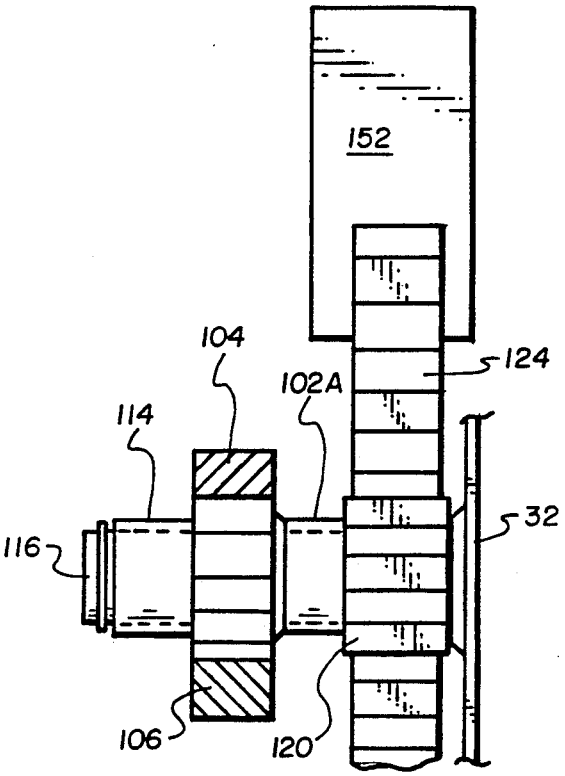
FIG. 8 is a side view of an auxiliary drive gear in mechanical association with two opposing rack gears, mounted coaxially with the auxiliary drive gear is an auxiliary drive gear in mechanical association with an upwardly directed rack gear.

Mounted coaxially on each axle 116 is a second auxiliary gear 120 (see FIGS. 3 and 8). Each gear 120 is mounted to its corresponding gear 114 by a sleeve-like extension 102A, which is structurally identical to extension 102. A rotation of each gear 114 effects a corresponding rotation of its associated gear 120. Each gear 120 is a toothed spur gear which is meshed with a vertically extending toothed rack gear 124. As shown, each rack gear 124 is supported and slidingly retained in an upright orientation by a pair of guide supports 128 which are structurally identical to the previously described guide supports 72. Each gear 120 is adapted to displace its associated rack gear 124 vertically, i.e. upwardly or downwardly, upon itself, being rotated by the displacement of its associated gear 114 and the rack gears 104 and 106 associated therewith.

Mounted elevationally below the main drive gear 44 is a plurality of spacedly positioned, toothed, third drive spur gears 130. Each of these third drive gears 130 is journaled on a respective axle 132 which is mounted on the interior face of the safe door to extend horizontally outward therefrom. Interposed between each pair of adjacent third drive gears 130 is a toothed intermediate idler spur gear 134. The teeth of each intermediate idler gear 134 mesh With the teeth of each of the teeth of the adjacent third drive gears 130 providing a means of transmitting motion from one third drive gear 130 to an adjacently positioned third drive gear 130.

Mounted on each third drive gear 130 and journaled coaxially therewith on a respective axle 132 is a toothed auxiliary spur drive gear 140. A rotation of each third drive gear 130 effects a corresponding rotation of its associated auxiliary drive gear 140. As shown, an auxiliary spur drive gear 140 is also coaxially mounted on main drive gear 44.

Each auxiliary drive gear 140 is interposed between a pair of opposing toothed rack gears 142 and 144. The teeth of the auxiliary drive gear 140 are meshed with the teeth of the rack gears 142 and 144, whereby a rotation of the auxiliary drive gear 140 causes a lateral displacement of each of the rack gears 142 and 142 in opposing directions. For example, a clockwise rotation of auxiliary drive gear 140A effects a displacement of rack gear 142A in the direction indicated by arrow 150 and a corresponding displacement of rack gear 142A in the direction indicated by arrow 152. Each rack gear 144 and 142 is supported and retained by a respective pair of guide supports 145 which structurally are identical to supports 72 described above.

The teeth of the lowermost positioned rack gears 142B and 144B are meshed with the teeth of a pair of spacedly positioned auxiliary spur gears 152. Each gear 152 is journaled on an axle 154 mounted on the interior face of the safe door to extend outwardly and horizontally therefrom. Each auxiliary gear 152 is connected to a respective toothed spur gear 156 which is coaxially journaled on the common axle 154. The arrangement of gears 152 and 156 is structurally identical to that previously described for gears 114 and 120. The teeth of each spur gear 156 is meshed with the teeth of a respective elongate rack gear 158 mounted vertically upright and adjacent its spur gear 156 by respective guides 160. Each of the rack gears 158 is adapted to be slidingly displaced vertically, i.e., upwardly and downwardly through its respective guide supports 160 upon the rotation of its respective spur gear 156.

FIGS. 3–8 illustrate, from a perspective or side view, some of the various gear relationships previously described.

FIG. 3 illustrates one of the vertically displaceable rack gears 124 whose teeth are meshed with the teeth of a spur gear 120 mounted on a horizontally disposed axle 116. Gear 120 is connected to spur gear 114 by a sleeve-like extension mounted coaxially on axle 116. As shown, the teeth of gear 114 are meshed with a horizontally disposed rack gear 106. The gear arrangement illustrated in FIG. 3 is identical to that described above regarding rack gear 158, spur gear 152, spur gear 156, and rack gear 142 as shown in the lower left-hand region of FIG. 2.

Figure 4:
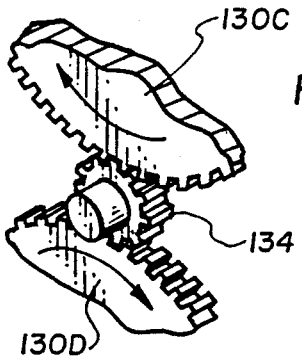
FIG. 4 is a sectional perspective view of an intermediate gear interposed between two drive gears.

FIG. 4 illustrates a toothed intermediate idler gear 134 interposed between a pair of adjacently positioned third drive gears 130C and 130D. As shown, the teeth of gear 134 are meshed with the teeth of the gears 130C and 130D. The intermediate idler gear 134 functions not only to transfer motion from one third drive gear 130C to an adjacent positioned third drive gear 130D, but furthermore, the intermediate idler gear 134 functions to cause each of the third drive gears to rotate in a common direction. As shown in FIG. 4, a clockwise rotation of third drive gear 130C would produce a corresponding counterclockwise rotation of intermediate gears 134 which in turn would produce a clockwise rotation of third drive gears 130D.

Figure 5:
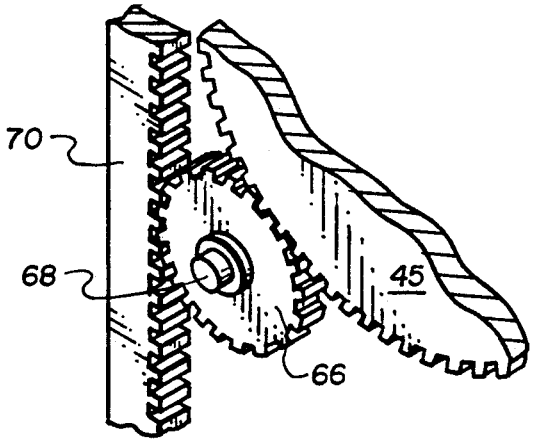
FIG. 5 is a sectional view of a first drive gear mechanically engaged with a pinion gear which in turn is mechanically engaged with an upright rack gear.

FIG. 5 shows the teeth of the first transfer spur gear 45 meshed with the pinion gear 66 which in turn is meshed with an upstanding rack gear 70.

Figure 6:
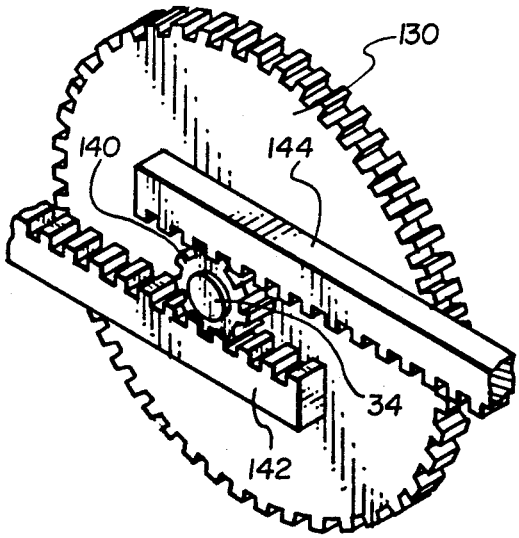
FIG. 6 is an elevated perspective view of a drive gear having an auxiliary drive gear mounted thereon, the auxiliary drive gear being in mechanical engagement with and being interposed between a pair of rack gears.

FIG. 6 shows a third drive gear 44 having a toothed auxiliary spur drive gear 140 mounted coaxially thereon. The teeth of the drive gear 140 are meshed with two opposingly mounted rack gears 142 and 144.

Figure 7:
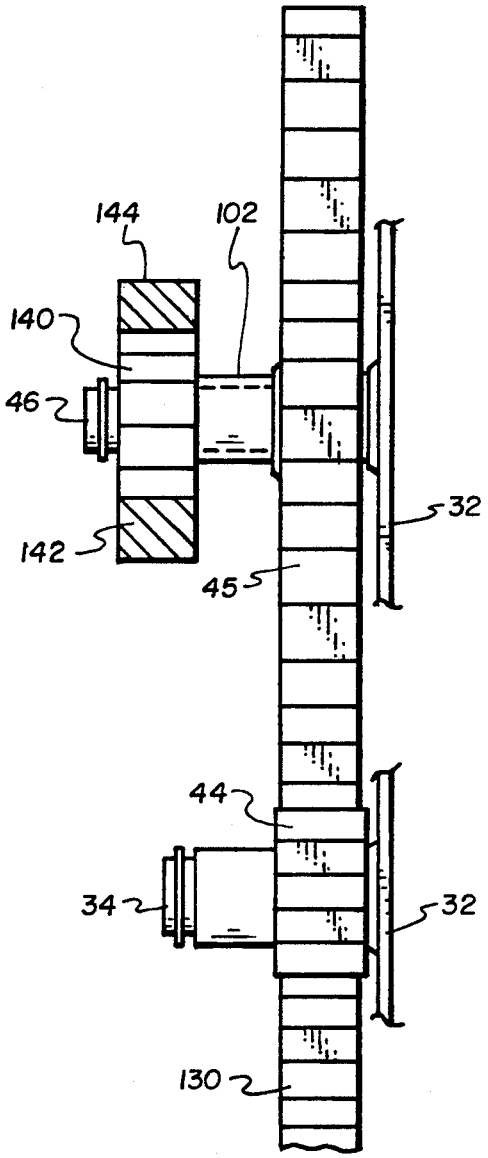
FIG. 7 is a side view of a main drive gear engaged with an intermediate idler gear which, in turn, is engaged with a third drive gear. An auxiliary drive gear is mounted coaxially with the main drive gear and is shown mechanically engaging opposing rack gears.

FIG. 7 shows the first transfer spur gear 45 rotatably mounted on axle 46. The teeth of gear 45 are meshed with the teeth of main drive gear 44 which is in turn rotatably mounted on axle 34. The teeth of main drive gear 44 are mechanically meshed with the teeth of third drive gear 130.

Mounted coaxially with first transfer spur gear 45 on axle 46 is an auxiliary drive gear 140. The gear 45 is connected to gear 140 by a sleeve-like extension 102, which is likewise rotatably mounted coaxially on axle 46. The teeth of gear 140 are mechanically meshed with the teeth of opposingly positioned rack gears 142 and 144.

FIG. 8 illustrates a vertically positioned rack gear 124 having a bolt or stud 152 mounted on an end thereof. The teeth of rack gear 124 are mechanically meshed with the teeth of a spur drive gear 120 which gear 120 is rotatably mounted on horizontally disposed axle 116. Spur gear 114 is mounted rotatably on axle 116 and is connected to gear 120 by sleeve-like extension member 102A. Gears 120 and 114 and extension member 102A are coaxially mounted on axle 116. The teeth of gear 114 are mechanically meshed with opposing rack gears 104 and 106.

As shown in FIG. 2, each of the rack gears included in the locking mechanism, with the exception of rack gear 70, is fitted on its end with a bolt or stud member 152. This stud member 152 is dimensioned to be slidingly received within a respective aperture 21 defined within the door frame 20 of the safe 10. As shown in FIG. 2, when the locking mechanism is actuated, the horizontally disposed rack gears 104, 106, 142, and 144 are displaced towards one or the other of the upright sides of the door 30. The vertically disposed rack gears 124 and 158 are each displaced toward the most proximate top or bottom edge of the door. Upon a given displacement of the various rack gears, the bolt members 152 mounted on each rack gear is urged into a locking engagement with its respective apertures 21 defined in the door frame 20. The bolt members 152 being inserted into the frame substantially about the entire perimeter of the door effect a substantially secure locking of the door 30 within the door frame 20.

Each of the aforesaid gears may be mounted on their respective axle by bearings.

In operation, the locking mechanism is actuated (i.e. locked) by the user's counterclockwise rotation of handle 36 about the axis defined by axle 34 (as viewed from the exterior of the safe). As the handle 36 is rotated, it effects a corresponding clockwise rotation of drive gear 44 (as viewed from the interior of safe 10). Due to its meshed engagement with gear 45, a rotation of gear 44 causes a corresponding clockwise rotation of gear 45.

As gear 44 is rotated, transfer gear 45 and auxiliary drive gear 140 are rotated counterclockwise due to their engagement with main drive gear 44. Gear 140 causes the displacement of rack gear 142 to the right and rack gear 144 to the left as indicated respectively by arrows 155 and 157. Upon a given rotation of gear 140 the studs 152 of rack gears 142 and 144 are inserted into their respective frame openings 21.

The rotation of main drive gear 44 also causes a clockwise rotation of pinion gear 66, which in turn causes an upward displacement of rack gear 70. As rack gear 70 is displaced upwards, it causes a clockwise rotation of pinion gear 94. The rotation of gear 94 causes a counterclockwise rotation of second spur drive gear 96. The rotation of gear 96 causes a corresponding counterclockwise rotation of auxiliary drive gear 100 which in turn causes a horizontal displacement of rack gears 104 and 106, respectively, in the direction indicated by arrows 112 and 110. The displacement of the rack gears 104 and 106 cause the counterclockwise rotation of spur gears 114. As each spur gear 114 rotates, it effects a corresponding counterclockwise rotation of spur gears 120 which in turn effect the upward displacement of each of the two vertical rack gears 124.

The clockwise rotation of main gear 44 also causes the counterclockwise rotation of third drive gear 130A. In turn, the counterclockwise rotation of gear 130A causes the clockwise rotation of idler gear 134. The clockwise rotation of idler gear 134 causes a corresponding counterclockwise rotation of the adjacent third drive gear 130. The interaction of idler gear 134 and adjacent third drive gear 130 continues along the train of idler gears and third drive gears.

The counterclockwise rotation of each third gear 130 effects a corresponding counterclockwise rotation of each auxiliary drive gear 140 associated therewith. In turn, the counterclockwise rotation of each auxiliary drive gear 140 causes a horizontal displacement of its associated rack gear 142 in the direction indicated by arrow 152. Further, that rotation causes a horizontal displacement of each corresponding rack gear 144 in the direction indicated by arrow 150.

The counterclockwise rotation of lowermost positioned third drive gear 130E through intermediation of rack gears 142 and 144 causes a corresponding counterclockwise rotation of spur gears 152 and their associated spur gears 156. This in turn causes the downward displacement of the rack gears 158.

Each of the aforesaid gears may be dimensioned and configured such that the first vertical arrays formed respectively by rack gears 142 and 106 and the second vertical array formed by rack gear 104 and 144 are each driven uniformly toward their respective proximate side edge at a common speed. Further, the top and bottom arrays formed respectively by rack gears 152 and 158 may also be regulated to proceed at a uniform rate correlated with the speed of the first and second vertical arrays. The invention therefore provides a means whereby a rotation of the handle 36 causes a uniform displacement of the various arrays of rack gears toward a locking engagement with their respective frame-defined apertures It is to be understood that the embodiments of the invention described are merely illustrative of the application of the principles of the invention. Reference herein to the details of the illustrated embodiment is not intended to limit the scope of the claims which themselves recite those features regarded as essential to the invention.

I claim:

1. A locking mechanism for use with a safe door enclosed in a frame, said locking mechanism comprising:

a drive shaft journaled through said safe door, a first end of said drive shaft having handle means associated therewith adapted for a grasping and rotation of said drive shaft by a user;

a first drive gear mounted on a second end of said drive shaft;

a second drive gear rotatably mounted on said safe door spacedly positioned from said first drive gear;

a securement means mounted on said safe door, between said first and second drive gears, for intercooperating with said first drive gear and locking same in a fixed non-rotating orientation;

a pair of pinion gears, mounted spacedly apart and rotatably on said safe door, each pinion gear being mechanically engaged respectively with one of said drive gears;

a pair of first auxiliary drive gears, each auxiliary drive gear being mounted coaxially and respectively on one of said drive gears;

a first rack gear slidably mounted on said safe door, said first rack gear being engaged with said pinion gears to provide a mechanical linkage therebetween;

two second rack gears, each second rack gear being slidably mounted on said safe door, one said second rack gear being mechanically engaged with a respective said auxiliary drive gear;

a pair of first retaining studs, one first stud being mounted on each of said second rack gears, said first retaining studs being adapted to interact with a frame of said safe door upon a first sliding displacement of its said second rack gear to form a locking engagement therewith;

wherein a rotation of said drive shaft effects said first sliding displacement of said second rack gears through intermediation of said pinion gears, said first rack gears and said first and second drive gears and said pair of auxiliary drive gears.

2. The locking mechanism of claim 1, wherein said first and second drive gears, said pinion gears, said first and second rack gears and said auxiliary drive gears are all toothed gears.

3. The locking mechanism of claim 2, wherein said securement means comprises an elongate shaft mounted for dual-directioned, non-rotating displacement on said safe door, said shaft being adapted to be inserted into said teeth of said first drive gear to lock said first drive gear into a non-rotating orientation.

4. The locking mechanism of claim 1, wherein each of said auxiliary drive gears is fitted with a third rack gear mechanically engaged therewith, adapted for sliding displacement along said safe door in a direction opposite to its corresponding paired second rack gear, each said third rack gear having a retaining stud mounted thereon adapted to lockingly engage said door frame upon a first displacement of said second rack gear.

5. The locking mechanism of claim 1, wherein each of said rack gears is mounted to said safe door by a guide adapted for supporting a siding displacement of its respective rack gear therealong.

6. The locking mechanism of claim 1, further including:

a plurality of third drive gears, mounted spacedly apart from one another and rotatably on said safe door;

a plurality of intermediate gears, each intermediate gear being positioned between a pair of said third drive gears and mechanically engaging each said pair;

a plurality of second auxiliary drive gears, each second auxiliary drive gear being mounted coaxially on a respective said third drive gear;

a plurality of third rack gears, each third rack gear being slidably mounted on said safe door and positioned in mechanical engagement with a respective said second auxiliary drive gear;

a plurality of second retaining studs, each said second retaining stud being mounted on a respective said third rack gear to lockingly engage said safe door frame upon a first sliding displacement of said second rack gears;

a connecting gear, rotatably mounted on said safe door in mechanical engagement with said first drive gear and one of said third drive gears;

wherein a rotation of said drive shaft effects a rotation of each of said third rack gears through intermediation of said first drive gear, said connecting gear, said auxiliary drive gears, said intermediate gears and said third drive gears.

7. A locking mechanism of claim 6, further comprising:

a plurality of fourth rack gears, each fourth rack gear being slidingly mounted on said safe door in mechanical engagement with a respective second auxiliary drive gear, each said fourth rack gear being adapted for displacement in a direction opposite to that of a corresponding third rack gear associated with a common second auxiliary drive gear; and a plurality of third retaining studs, each said third retaining stud being mounted on a respective fourth rack gear to lockingly engage said safe door frame upon a first sliding displacement of said second rack gears.

8. The locking mechanism of claim 1, further comprising:

a fourth drive gear rotatably mounted on said safe door in mechanical engagement with one of said second rack gears;

a fifth rack gear slidingly mounted on said safe door for displacement in a direction perpendicular to said second rack gear's direction of displacement, said fifth rack gearing being positioned in mechanical engagement with said fourth drive gear; and a fourth retaining stud mounted on said fifth rack gear, said fifth stud being adapted to lockingly engage said safe door frame upon a first sliding displacement of said second rack gears.

9. The locking mechanism of claim 8, further comprising:

a pair of fourth drive gears rotatably mounted on said safe door, said fourth drive gears being positioned spacedly apart from one another and between one of said pair of second rack gears and third rack gear, said fourth drive gear being positioned in mechanical engagement with said second and third rack gear;

a pair of fifth rack gears slidingly mounted on said safe door for displacement in a direction perpendicular to said second rack gears' direction of displacement, each said fifth rack gear being positioned in mechanical engagement with a respective said fourth drive gear; and a pair of fourth retaining studs, each said fourth retaining stud being mounted on a respective said fifth rack gear adapted to lockingly engage with said safe door frame upon a first displacement of said second rack gears.

10. The locking mechanism of claim 9, further comprising:

a pair of fifth drive gears rotatably mounted on said safe door, said fifth drive gears being mounted spacedly apart from one another and in mechanical engagement with one of said third rack gears;

a pair of fifth rack gears slidingly mounted on said safe door for displacement in a direction perpendicular to said third rack gears, each said fifth rack gear being mechanically engaged with a respective said fifth drive gear;

a pair of fourth retaining studs, each fourth retaining stud being mounted on a respective said fifth rack gear adapted to lockingly engage with said safe door frame upon a first displacement of said second rack gears.

* * * * *